United States Patent [19]

Mulcahy

[11] Patent Number: 4,512,799

[45] Date of Patent: Apr. 23, 1985

[54] VACUUM TREATING STEELS

[75] Inventor: Joseph A. Mulcahy, Brooklin, Canada

[73] Assignee: J. Mulcahy Enterprises Incorporated, Whitby, Canada

[21] Appl. No.: 575,202

[22] Filed: Jan. 30, 1984

[51] Int. Cl.[3] ..... C21C 7/10

[52] U.S. Cl. ..... 75/49; 266/207; 266/208

[58] Field of Search ..... 75/49; 266/207, 208

[56] References Cited

U.S. PATENT DOCUMENTS 3,798,025 3/1974 Ramachandran ..... 75/49

*Primary Examiner*—Peter D. Rosenberg

*Attorney, Agent, or Firm*—Sim & McBurney

[57] ABSTRACT

Molten steel or other electroconductive metal is treated with vacuum to remove dissolved gases therefrom. A rod of molten steel is drawn from a bath by applying vaccum to a vertical tube dipping into the molten bath. An electrical coil surrounding the tube applies an intense magnetic field to the steel rod by the passage of high frequency alternating current through the coil. The rod is compressed radially inwardly by the magnetic field exposing the whole of the external surface of the rod to vacuum. At the same time, the induced eddy currents superheat the steel rod. The large surface area of application of vacuum combined with the narrow dimension through which the gas must travel ensure rapid and efficient removal of the gases. The procedure is repeated until all the steel in the bath has been treated. Lack of contact of the steel rod with the tube surface eliminates loss of heat by convection and the superheating of the steel rod by the eddy currents ensures that the overall heat losses are minimal during processing of the molten metal bath.

10 Claims, 2 Drawing Figures

VACUUM TREATING STEELS

FIELD OF INVENTION

The present invention relates to the processing of steels.

BACKGROUND TO THE INVENTION

The presence of dissolved gases, including hydrogen, oxygen and nitrogen, in metals, for example, steels can cause several undesirable effects, such as, internal ruptures or flaking, embrittlement, void formation and inclusions. It is desirable, therefore, to remove the dissolved gases prior to solidification of the metal and vacuum often is employed for such purpose. The molten metal is housed in a large chamber and is agitated to facilitate removal of the gases by vacuum applied to the chamber. This prior art operation, however, is somewhat unsatisfactory, in that a molten metal to be treated must be tapped from a furnace with sufficient temperature to withstand heat losses during treatment, and efficient removal of the gas is not achieved.

SUMMARY OF INVENTION

In accordance with the present invention, a novel method of degassing metals is provided. The invention is particularly applicable to the treatment of molten steel and will be described mainly with reference thereto, but the invention is also applicable to any other electroconductive metal. In the present invention, molten steel is drawn from a bath into a vertical column by the vacuum, a high frequency coil surrounds the vertical column and a high frequency alternating electrical current is passed through the coil to provide an electrical field which compresses and contracts the vertical steel rod away from its confining walls. In this way the whole of the outer surface of the rod is exposed to vacuum and gas is drawn from the considerable surface area of the thin steel rod exposed to the vacuum. The vacuum then is shut off, permitting the rod of degassed steel to return to the bath. The process then is repeated until all the gases have been removed. While being subjected to vacuum, the molten steel column is also inductively superheated by the eddy currents induced in the molten steel.

In addition to effecting efficient removal of dissolved gases from the molten steel, heat losses from the molten steel are minimized, since no conductive losses occur through contact with the confining walls and heat is added to the steel rod through the induced eddy currents.

As a result of the minimization of heat losses during treatment, the temperature at which the molten metal needs to be tapped from the furnace can be lower than in the prior art, typically about 1600° C. for the present invention in comparison with about 1650° C. for the prior art.

Although only a portion of the molten steel is treated at one time, the high efficiency of gas removal from the large surface area of the thin steel rod enables the dissolved gas content of the steel to be depleted to a very low level in a manageable number of passes. Depending upon the volume of molten steel to be vacuum treated, a single treatment unit may be employed or a plurality of such treatment units may be used.

DESCRIPTION OF PREFERRED EMBODIMENT

Figure 1:
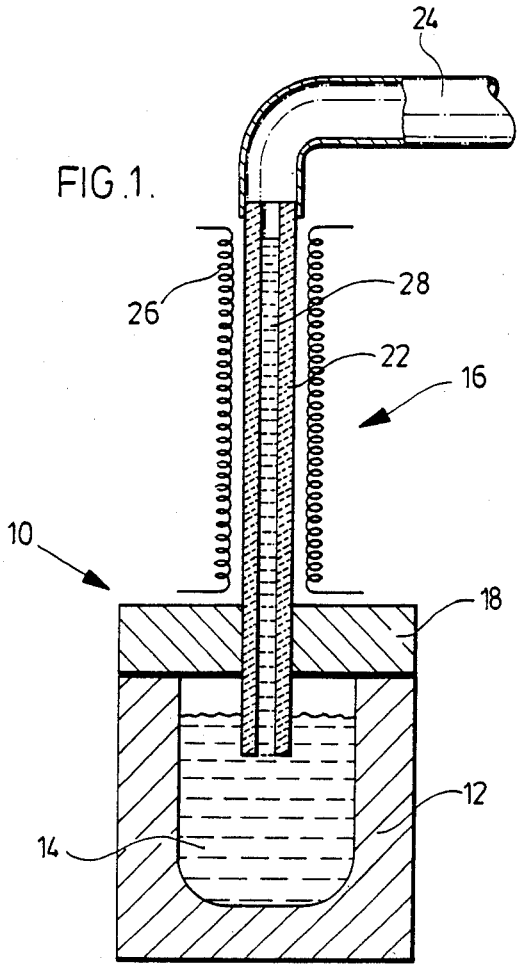
FIG. 1 of the drawings is a sectional view illustrating one embodiment of an apparatus for effecting vacuum treating of steel in accordance with one embodiment of the invention.

Referring to the drawings, a steel-treating apparatus 10 comprises a pot 12 containing a bath 14 of molten steel to be treated. The bath may be stirred by any convenient procedure, for example, argon gas stirring or electromagnetic stirring.

A vacuum application unit 16 is used to effect treatment of the steel. The unit comprises a support member 18 which overlies the top of the pot 12 to enclose the molten steel bath 14. A hollow tube 22 extends through the support member 18 and dips into the bath 14. The tube 22 may be constructed of any convenient non-electrically-conducting and non-magnetic material, such as heat resistant refractory material.

The hollow tube at its upper end communicates with a vacuum line 24 whereby vacuum may be applied to the interior of the tube 22. An electrical coil 26 is wound around the exterior of the tube 22 and is connected to a source of high frequency alternating current (not shown).

While a single vacuum application unit 16 is illustrated for treatment of the molten steel bath 14, a plurality of such units 16 may be employed, the number depending on the volume of molten steel to be treated.

OPERATION

Figure 2:
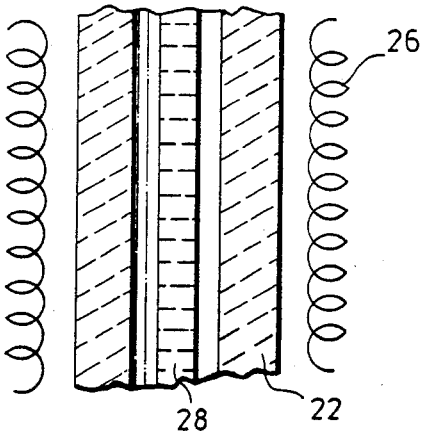
FIG. 2 is a close-up view of a portion of the apparatus of FIG. 1.

In operation, vacuum is applied to the interior of the tube 22 by vacuum line 24, causing a rod of molten steel 28 to be drawn up into the hollow tube 22. A high frequency alternating current, preferably at a frequency of about 25 to about 50 kHz, is passed through the coil 26. The resulting magnetic field establishes eddy currents in the molten steel rod 28 which adds superheat and counteracts heat losses. The eddy currents also result in a repellant magnetic field which causes the molten steel rod 28 to contract radially inwardly and to become detached from the inner wall of the tube 22, as shown in the detailed close up of FIG. 2.

Since the molten steel rod 28 is detached from the inside wall of the tube 22, the whole of the exterior surface of the steel rod 28 over the length of the coil 26 is exposed to the vacuum applied by the vacuum tube 24. The narrow diameter of the rod 28 and the large surface area of the rod which is exposed to the vacuum permit dissolved gases to be readily and substantially completely removed from the steel rod 28.

Once the vacuum treatment of the molten steel rod 28 is complete, the vacuum is shut off, permitting the vacuum treated rod 28 to return to the bath 14. When a plurality of vacuum application units 16 is used, the vacuum may be applied and released simultaneously to all or a selected number of the tubes 22 or may be applied and released sequentially to the tubes 22.

The procedure described above then is repeated a sufficient number of times to treat all the molten steel in the bath 14. In the vacuum treatment process, hydrogen, oxygen and nitrogen are removed, while carbon also is removed as a reaction product of carbon and oxygen.

The vacuum may have any desired value to achieve the drawing of the steel rod 28 into the tube 22 and to withdraw the dissolved gases from the molten steel rod. Usually, a vacuum of about 10 to about 300 torrs is used.

The number of cycles necessary to effect complete treatment depends on the overall volume of the molten metal, the diameter of the tube 22 and the value of the vacuum. Usually about 30 to 50 cycles is sufficient, with each cycle being about 30 to 60 seconds in duration.

The procedure of the invention enables dissolved gases to be removed from molten steel or other electroconductive metals efficiently and rapidly in an energy-efficient manner. The present invention thereby overcomes the problems of prior art procedures for vacuum treating of such metals.

SUMMARY OF DISCLOSURE

In summary of this disclosure, the present invention provides a novel method and apparatus for vacuum treating of steel or other electroconductive metal to remove dissolved gases therefrom, which involves exposure of a large surface area of narrow thickness of the molten metal to the action of vacuum while simultaneously heating the metal. Modifications are possible within the scope of this invention.

What I claim is:

1. A method for the vacuum treating of molten metals, which comprises:

applying vacuum to a tube dipping into a molten bath of an electroconductive metal to draw said molten metal into said tube and to form an elongate rod of said molten metal within said tube, and electromagnetically radially-inwardly compressing the elongate rod, so as to detach said elongate rod from the internal wall of said tube and to expose the external surface of the electromagnetically-compressed rod to said vacuum, thereby to withdraw dissolved gases from said molten metal rod.

2. The method of claim 1, wherein said electromagnetic compression is effected by forming an electric coil about the external surface of said tube and passing a high frequency alternating current through said coil.

3. The method of claim 2 wherein said frequency is about 25 to about 50 kHz.

4. The method of claim 1, including, prior to said vacuum application step, providing said molten bath of steel in a container, and inserting said tube into said molten metal bath so as to dip into said molten metal bath and to extend substantially vertically upwardly therefrom.

5. The method of claim 4 including, following said electromagnetic compression of said molten metal rod and when said exposure of the external surface of the electromagnetically-compressed rod to said vacuum has been effected for a desired period of time, releasing said vacuum from said tube to permit the resulting vacuum-treated rod to fall back into the molten bath.

6. The method of claim 5 carried out repetitively for a desired number of cycles to permit substantially complete withdrawal of dissolved gases from all the metal in said molten bath.

7. The method of claim 6, including stirring said molten bath during the repetitive operations.

8. The method of claim 1 wherein said tube is formed of heat-resistant refractory material.

9. The method of claim 1 wherein said electroconductive metal is steel.

10. The method of claim 1, wherein a plurality of tubes are dipped into said molten bath to each of which vacuum is applied and the elongate rod in each tube is electromagnetically-compressed.

* * * * *